US007335111B2

(12) United States Patent
Deakes

(10) Patent No.: US 7,335,111 B2
(45) Date of Patent: Feb. 26, 2008

(54) POOL CUE WITH LIGHT CONDUCTING CORE

(76) Inventor: Brandon Forrest Deakes, 34 Holly Cir., Kinsale, VA (US) 22488

( * ) Notice: Subject to any disclaimer, the term of this patent is extended or adjusted under 35 U.S.C. 154(b) by 0 days.

(21) Appl. No.: 11/375,389

(22) Filed: Mar. 14, 2006

(65) Prior Publication Data

US 2007/0219008 A1 Sep. 20, 2007

(51) Int. Cl.
*A63D 15/08* (2006.01)

(52) U.S. Cl. ..... 473/44

(58) Field of Classification Search ..... 473/44–49
See application file for complete search history.

(56) References Cited

U.S. PATENT DOCUMENTS

| | | | | | |
|---|---|---|---|---|---|
| 835,489 | A * | 11/1906 | Adorjan | 473/47 |
| 3,804,411 | A | 4/1974 | Hendry | |
| 4,688,796 | A * | 8/1987 | Wright | 473/2 |
| 5,181,718 | A * | 1/1993 | Valentine | 473/2 |
| 5,653,640 | A | 8/1997 | Shirley, Jr. | |
| 6,017,277 | A * | 1/2000 | Chuang | 473/44 |
| 6,117,019 | A * | 9/2000 | Taylor | 473/46 |
| 6,155,929 | A * | 12/2000 | Chipman | 473/2 |
| 6,165,078 | A | 12/2000 | Holt | |
| 6,746,336 | B1 * | 6/2004 | Brant et al. | 473/44 |
| 6,827,652 | B1 * | 12/2004 | Castro, Jr. | 473/44 |
| 2006/0247068 | A1 * | 11/2006 | Lagaipa | 473/44 |

* cited by examiner

*Primary Examiner*—Mark S Graham
(74) *Attorney, Agent, or Firm*—Raymond M. Galasso; Galasso & Associates, LP

(57) ABSTRACT

A pool cue that includes a first hollow rod with a light source connected to a second hollow rod via a light conducting coupler is disclosed herein. Thus, the light source can project light the length of the cue. The coupler can be hollow or a made from a translucent material. The light source can be a light emitting diode (LED) powered by disk shaped watch batteries. Different inserts can be placed in the hollow rods to change the color and the illumination pattern of the cue. Inserts can also be added to change the weight of the pool cue. The pool cue can also have a tubular mirror insertable into the first hollow rod where the grip is to minimize the absorption of light in these areas.

17 Claims, 1 Drawing Sheet

A-A

A-A

POOL CUE WITH LIGHT CONDUCTING CORE

FIELD OF THE DISCLOSURE

The present disclosure is generally related to a pool cue and more particularly to a pool cue that has a light conducting core.

BACKGROUND

Pool cues come in many shapes and sizes. Some pool cues are decorated with ivory or gold inlays, while others are made from exotic types of wood. Serious pool players often bring a custom pool cue to a pool match, sometimes in an effort to gain a psychological advantage over other players. One such custom pool cue includes an illuminated pool cue such as the one described in U.S. Pat. No. 6,165,078. This patent discloses a dual bulb system, having a light bulb in the but end of the cue and a bulb in the tip end of the cue, wherein this two bulb system is required for lighting both sections of the two piece pool cue. Since during use, a pool cue must be gripped at one end and slide across the user's skin at another end, placement of the switches for such a dual bulb system is awkward and difficult. This dual bulb arrangement also causes many other difficulties such as proper weight distribution within the pool cue because batteries and a light fixture are required at each end of the cue. Additionally, the incandescent light bulbs disclosed in this patent are subject to burning out as a result of the impact required to hit pool balls. Another shortcoming is that the two piece pool cue does not uniformly spread light throughout the pool cue.

DETAILED DESCRIPTION OF THE DRAWINGS

The following is a detailed description of novel embodiments depicted in the accompanying drawings. The embodiments are in such detail as to clearly communicate the subject matter. However, the amount of detail offered is not intended to limit anticipated variations of the described embodiments, but on the contrary, the claims and detailed description are to cover all modifications, equivalents, and alternatives falling within the spirit and scope of the present teachings as defined by the appended claims. The detailed descriptions below are designed to make such embodiments understandable to a person having ordinary skill in the art.

Generally, methods and arrangements for a lighted pool cue are provided herein. While specific embodiments will be described below with reference to particular configurations, those of skill in the art will realize that embodiments may advantageously be implemented with other configurations.

A pool cue comprising a first translucent rod connected to a second translucent rod with a light conducting coupler is disclosed. The first rod can have a light source that projects light the length of the cue. The first and second translucent rods can have a hollow core and can be joined by a hollow coupler such that a light beam from the light source can travel along the core and illuminate the first rod and the second rod. The hollow coupler can have threads that engage the first and second rods.

The light source, batteries and a switch can be assembled into a cap that can be attached to the first end of the first rod. Different light conducting inserts can be placed in the hollow core of the rods to change the color and pattern of the light emitted from the cue. Further, metallic inserts can be inserted into the hollow rod to change the weight and balance of the pool cue. The pool cue can also have a tubular mirror insertable into the first hollow rod to mask the light output in specific sections of the pool cue and to minimize the absorption of light in these sections.

Figure 1:
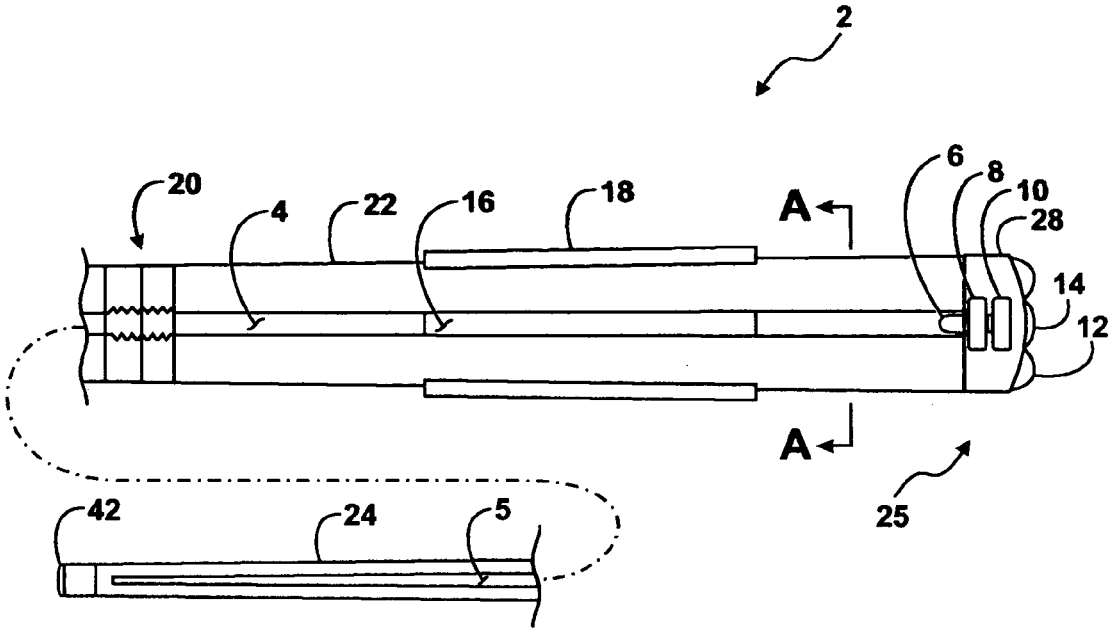
FIG. 1 is a side view of a pool cue with a lighted core.

Referring to FIG. 1, a pool cue 2 with a hollow core that allows for light from a single light source to travel along at least the majority of the pool cue 2 is provided. The pool cue 2 can be comprised of a first translucent rod 22 and a second translucent rod 24. The first rod 22 and the second rod 24 can have a hollow core 4 and 5 respectively (i.e. have an internal air space concentric with the rod). In one embodiment, the rods 22 and 24 can be made from a transparent or translucent plastic or glass material such as a polycarbonate or an acrylic. In one embodiment, the coupler between the first and second rods can be made from a transparent or translucent material such that light from a light source 6 at the first end 25 of the first rod 22 can travel through the coupler 20 to the far end of the second rod 24. Additionally, a translucent material of various shapes can also be placed in the hollow cores 4 and 5.

The first rod 22 can be coupled to the second rod 24 with a coupler 20 that provides a conduit for the light or for the conduction of light. Hence, the coupler 20 may provide only a small obstruction to the light beam and can assist in conducting the light throughout the cue 2. In one embodiment the coupler 20 has a hollow center or a translucent center such that at least a portion of a light beam generated in the first end 25 of the first rod 22 passes through the coupler 20 to illuminate substantially the entire second rod 24. Thus, the light from the light source 6 can traverse the first rod 22, the coupler 20 and nearly the entire second rod 24.

The first rod 22 can have threads at its first end 25 to engage threaded cap 28. The threaded cap 28 can secure a bumper 14, batteries 8 and 10, a switch 12 and a light source 6 such as a light emitting diode (LED). The user of the pool cue 2 can depress switch 12, to engage contacts within the switch 12 between the batteries 8 and 10 and the light source 6. Batteries 8 and 10 could be disc shaped batteries such as those utilized in watches and in hand held calculators that are less one half of an inch in diameter, less than one eight inch thick and weigh only a few ounces.

A spring loaded contact on cap 28 could be utilized to secure the switch 12 to the batteries 8 and 10. The spring in the cap 28 can also facilitate electrical contact between the switch 12, the batteries 8 and 10, and the LED 6. The LED 6 can be easily interchanged with LED's of different colors such that different colors can be emitted from the pool cue 2. The first rod 22 can also include a grip 18. Under the grip 18 can be a tubular mirrored surface 16 facing the center of the first rod 22 such that there is minimal absorption of light in the area where the mirrored surface 16 is placed.

In one embodiment the rods 22 and 24 can be made, at least partially from a translucent material such as a polycarbonate or acrylic including Lexan® or Plexiglas®. Additionally, interchangeable insert can be made in different shapes, with different patterns and from different materials such that the properties of the light that is emitted from the pool cue 2 can be selectable.

Thus, the insert can fit into the hollow cores 4 and 5 to modify the properties of the light emitted. The insert can also act as a light pipe to evenly distribute the light along the cue 4 and the inserts can be configured such that they control the spectrum, refraction and reflection of the light beam. Further, the insert can be manufactured in different colors with different patterns and optical properties such that the pool cue 2 can emit different colors of light and can emit different patterns of light. Metallic flakes and patterns could also be cast or impregnated into the translucent material.

A leather tip 42 can be glued on to one end of the second rod 22. The hollow portion 5 of the second rod 24 can taper towards the tip 42 with a taper that is similar to, or parallel with, the external taper of the second rod 24. The hollow portion of the taper could end short of the tip 42 such as not to compromise the strength of the pool cue 2 near the tip 42.

The core 4 of the first rod 22 can take many shapes and such shapes can dictate the pattern of the light that is emitted from pool cue 2. For example, a cross section of the core 4 could be a circle, a square, a triangle, an oval, an ellipse or a polygon such as a hexagon. As stated above, the cores 4 and 5 could be hollow (i.e. provide an air space) or the cores could be made from, or filled with, an interchangeable translucent material. Likewise, core 5 and the coupler 20 could be hollow or made with a non-removable translucent material such that light can be conducted the entire length of the pool cue 2.

Figure 2:
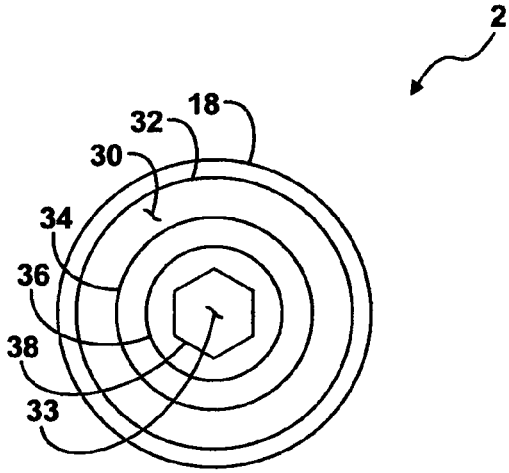
FIG. 2 is a cross sectional view of the pool cue.

Referring to FIG. 2 a cut away section of the pool cue 2 near the first end 25 of the first rod 22 of FIG. 1 is illustrated. The cross section of the core 33 of the pool cue 2 can have be manufactured in many different shapes, however a hexagonal cross sectional shape 38 is illustrated. As stated above, a mirror structure 36 can be placed into the first rod in the area defined by the grip 18 such that the light energy has minimal absorption in the segment of the first rod where the grip 18 is located. In addition a metal sleeve 34 may be inserted into the area covered by the grip 18 such that the weight and balance of the pool cue 2 can be adjusted or changed. A translucent member 30 can define the area between the core 33 and the external surface 32 of the pool cue 2.

The above disclosed subject matter is to be considered illustrative, and not restrictive, and the appended claims are intended to cover all such modifications, enhancements, and other embodiments which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A pool cue comprising:

a first rod having a first end and a second end;

a light source coupled to the first end of the first rod;

a light conducting coupler threadable with the first rod;

a second rod threadable with the light conducting coupler such that light from the light source at the first end of the first rod traverses the light conducting coupler and emits light from at least a portion of the second rod; and a tubular mirror insertable into the first rod.

2. The pool cue of claim 1 wherein the light source comprises a light emitting diode.

3. The pool cue of claim 1 further comprising a threaded cap adapted to secure the light source, at least one battery, and a switch to the first end of the first rod.

4. The pool cue of claim 3 wherein the threaded cap further comprises a conductive spring adapted to make contact with the at least one battery.

5. The pool cue of claim 3 wherein the at least one battery comprise a disk shaped battery.

6. The pool cue of claim 1 wherein the first rod and the second rod are hollow.

7. The pool cue of claim 6 further comprising a translucent member insertable into the first rod.

8. The pool cue of claim 7 wherein the translucent member has a shape of on of a triangle, a hexagon, a square, and a polygon.

9. The pool cue of claim 1 further comprising a tubular piece of metal insertable into the first rod to change a weight distribution of the pool cue.

10. A pool cue comprising:

a first rod having a light conducting core and an insertable member that alters the properties of the light, the first rod having a first end and a second end;

a light source coupleable to the first end of the first rod, substantially concentric with the light conducting core;

a light conducting coupler threadably coupleable with the second end of the first rod;

a tapered rod having a light conducting core, the tapered rod threadably coupleable with the light conducting coupler such that light originating from the light source traverses the hollow coupler and illuminates the tapered rod; and a tubular mirror positionable under a grip in the first rod.

11. The pool cue of claim 10 wherein the light conducting coupler is translucent.

12. The pool cue of claim 10 wherein the light conducting coupler is hollow.

13. The pool cue of claim 10 wherein the coupler comprises one of an acrylic or a polycarbonate material.

14. The pool cue of claim 10 wherein the light source further comprises a light emitting diode.

15. The pool cue of claim 10 further comprising a threaded cap adapted to secure the light source to the first rod.

16. The pool cue of claim 15 further comprising a switch coupled to the threaded cap.

17. The pool cue of claim 10 further comprising inserts insertable into the first rod.

* * * * *